US012495828B2

(12) United States Patent
Batista et al.

(10) Patent No.: US 12,495,828 B2
(45) Date of Patent: Dec. 16, 2025

(54) AEROSOL-GENERATING DEVICE WITH MOVABLE PORTIONS

(71) Applicant: PHILIP MORRIS PRODUCTS S.A., Neuchatel (CH)

(72) Inventors: Rui Nuno Batista, Morges (CH); Daria Tzimoulis, La Croix-sur-Lutry (CH); Adela Sahraoui, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 412 days.

(21) Appl. No.: 17/782,789

(22) PCT Filed: Dec. 14, 2020

(86) PCT No.: PCT/EP2020/086011
§ 371 (c)(1),
(2) Date: Jun. 6, 2022

(87) PCT Pub. No.: WO2021/122470
PCT Pub. Date: Jun. 24, 2021

(65) Prior Publication Data

US 2023/0010872 A1 Jan. 12, 2023

(30) Foreign Application Priority Data

Dec. 16, 2019 (EP) ..... 19386055

(51) Int. Cl.
*A24F 40/40* (2020.01)
*A24F 40/20* (2020.01)
(Continued)

(52) U.S. Cl.
CPC ..... *A24F 40/40* (2020.01); *A24F 40/20* (2020.01); *A24F 40/53* (2020.01); *A24F 40/65* (2020.01)

(58) Field of Classification Search
None
See application file for complete search history.

(56) References Cited

U.S. PATENT DOCUMENTS 10,327,479 B2 6/2019 Popplewell
10,869,501 B2 12/2020 Thorens
(Continued)

FOREIGN PATENT DOCUMENTS

CN 107890141 4/2018
CN 108158043 6/2018
(Continued)

OTHER PUBLICATIONS

CN 107890141 A, English Translation obtained from Espacenet, pp. 1-8 (Year: 2024).*
(Continued)

*Primary Examiner* — Philip Y Louie
*Assistant Examiner* — John Mitchell Martin
(74) *Attorney, Agent, or Firm* — Mueting Raasch Group

(57) ABSTRACT

The invention relates to an aerosol-generating device. The aerosol-generating device comprises a first housing portion and a second housing portion. The first housing portion comprises a cavity for receiving an aerosol-generating article comprising aerosol-forming substrate. The first housing portion and second housing portion are configured arrangeable in a first position, in which the first housing portion is extended relative to the second housing position, and in which the cavity is accessible for insertion of the aerosol-generating article. The first housing portion and second housing portion are configured arrangeable in a second position, in which the second housing portion is retracted at least partly within the cavity.

21 Claims, 6 Drawing Sheets

(51) Int. Cl.
*A24F 40/53* (2020.01)
*A24F 40/65* (2020.01)

(56) References Cited

U.S. PATENT DOCUMENTS

| | | | | |
|---|---|---|---|---|
| 10,925,318 | B2 | 2/2021 | Martzel | |
| 2018/0043114 | A1 | 2/2018 | Bowen | |
| 2020/0352249 | A1* | 11/2020 | Achtien | A61M 15/0066 |
| 2021/0244097 | A1 | 8/2021 | Qui | |
| 2021/0282459 | A1* | 9/2021 | Yamaguchi | A24F 40/46 |
| 2022/0142251 | A1* | 5/2022 | Korus | A24F 40/57 |

FOREIGN PATENT DOCUMENTS

| | | |
|---|---|---|
| CN | 109077366 | 12/2018 |
| CN | 110403242 | 11/2019 |
| CN | 110547510 | 12/2019 |
| JP | 2019-518441 | 7/2019 |
| JP | 2019-521739 | 8/2019 |
| KR | 19-0131053 | 11/2019 |
| RU | 2655184 | 5/2018 |
| WO | WO 2015/039280 | 3/2015 |
| WO | WO 2015/157900 | 10/2015 |
| WO | WO 2017/186455 | 11/2017 |
| WO | WO 2018/190605 | 10/2018 |
| WO | WO 2019/030172 | 2/2019 |
| WO | WO 2019/030360 | 2/2019 |
| WO | WO 2019037880 | 2/2019 |
| WO | WO 2019/162505 | 8/2019 |

OTHER PUBLICATIONS

Decision to Grant issued for Japanese Application No. 2022-536863 dated Mar. 6, 2024 (1 page).
PCT Search Report and Written Opinion for PCT/EP2020/086011 dated Dec. 21, 2020 (14 pages).
Office Action issued in Russia for Application No. 2022116040 dated Dec. 29, 2022 (4 pages). English translation included.
Office Action issued in Japan for Application No. 2022-536863 dated Jun. 22, 2023 (3 pages).
Office Action issued in Korea for Application No. 10-2022-7020353 dated Jun. 11, 2024 (9 pages). English translation included.
Office Action issued in China for Application No. 202080066705.7 dated Jan. 4, 2025 (23 pages). English translation included.
Office Action issued in China for Application No. 202080066705.7 dated Jul. 16, 2025 (27 pages). English translation included.

* cited by examiner

AEROSOL-GENERATING DEVICE WITH MOVABLE PORTIONS

This application is a U.S. National Stage Application of International Application No. PCT/EP2020/086011 filed Dec. 14, 2020, which was published in English on Jun. 24, 2021, as International Publication No. WO 2021/122470 A1. International Application No. PCT/EP2020/086011 claims priority to European Application No. 19386055.8 filed Dec. 16, 2019.

The present invention relates to an aerosol-generating device and an aerosol-generating system comprising the aerosol-generating device and an aerosol-generating article comprising aerosol-forming substrate.

It is known to provide an aerosol-generating device for generating an inhalable vapor. Such devices may heat an aerosol-forming substrate to a temperature at which one or more components of the aerosol-forming substrate are volatilised without burning the aerosol-forming substrate. Aerosol-forming substrate may be provided as part of an aerosol-generating article. The aerosol-generating article may have a rod shape for insertion of the aerosol-generating article into a cavity, such as a heating chamber, of the aerosol-generating device. A heating element may be arranged in or around the heating chamber for heating the aerosol-forming substrate once the aerosol-generating article is inserted into the heating chamber of the aerosol-generating device. The open cavity of the aerosol-generating device may be problematic when the aerosol-generating device is not in use. Potentially, a user or a bystander may, accidentally or otherwise, reach into the cavity of the aerosol-generating device. As a result, the user or bystander may be subjected to the elevated temperature of the cavity. Further, elements of the aerosol-generating device may be damaged or the inside of the cavity contaminated.

It would be desirable to have an aerosol-generating device with improved closure of the cavity when the aerosol-generating device is not in use. It would be desirable to have an aerosol-generating device where the cavity for insertion of the aerosol-generating article is protected. It would be desirable to have an aerosol-generating device in which contamination of the cavity is prevented.

According to an embodiment of the invention there is provided an aerosol-generating device. The aerosol-generating device may comprise a first housing portion and a second housing portion. The first housing portion may comprise a cavity for receiving an aerosol-generating article comprising aerosol-forming substrate. The first housing portion and second housing portion may be configured arrangeable in a first position, in which the first housing portion is extended relative to the second housing portion, and in which the cavity is accessible for insertion of the aerosol-generating article. The first housing portion and second housing portion may be configured arrangeable in a second position, in which the second housing portion is retracted at least partly within the cavity.

According to an embodiment of the invention there is provided an aerosol-generating device. The aerosol-generating device comprises a first housing portion and a second housing portion. The first housing portion comprises a cavity for receiving an aerosol-generating article comprising aerosol-forming substrate. The first housing portion and second housing portion are configured arrangeable in a first position, in which the first housing portion is extended relative to the second housing position, and in which the cavity is accessible for insertion of the aerosol-generating article. The first housing portion and second housing portion are configured arrangeable in a second position, in which the second housing portion is retracted at least partly within the cavity of the first housing portion.

In the first position, the aerosol-generating device is configured to be used. The aerosol-generating article can be inserted into the cavity of the first housing portion. Subsequently, the aerosol-generating device may be operated to generate an inhalable aerosol by heating the aerosol-forming substrate of the aerosol-generating article. After usage, the aerosol-generating article may be removed from the cavity of the first housing portion. The aerosol-generating device may then be moved from the first position to the second position. In the second position, the second housing portion is retracted at least partly within the cavity. In this position, the space of the cavity may be taken up by the second housing portion. Preferably, the cavity is inaccessible for insertion of the aerosol-generating article in the second position. In this way, the cavity may be protected. Particularly, a user or bystander may not be able to reach into the cavity. Further, contamination of the cavity may be prevented by the second housing portion being arranged within the cavity in the second position.

The cavity may be a heating chamber. The cavity may have a cylindrical shape. The cavity may have a hollow cylindrical shape. The cavity may have a circular cross-section. If desirable, the cavity may have a shape deviating from a cylindrical shape or a cross-section deviating from a circular cross-section. The cavity may have a shape corresponding to the shape of the aerosol-generating article to be received in the cavity. The cavity may have an elliptical or rectangular cross-section. The cavity may have a base at an upstream end of the cavity. The base may be circular. One or more air inlets may be arranged at or adjacent the base. The air inlets may be arranged in one or more of the base of the cavity and in the sidewall of the cavity adjacent the base of the cavity. An airflow channel may run through the cavity. Ambient air may be drawn into the aerosol-generating device, into the cavity and towards the user through the airflow channel. Downstream of the cavity, a mouthpiece may be arranged or a user may directly draw on the aerosol-generating article. The mouthpiece may be part of the aerosol-generating article. The airflow channel may extend through the mouthpiece.

The base of the cavity may be formed by a proximal end face of the second housing portion. The proximal end face of the second housing portion may be arranged at an upstream end of the cavity. The second housing portion may directly abut the cavity of the first housing portion. The second housing portion may be in direct contact with the cavity of the first housing portion.

A proximal portion of the second housing portion may have a shape corresponding to a shape of the cavity of the first housing portion. Advantageously, correspondingly shaped proximal portion of the second housing portion and cavity means that the proximal portion of the second housing portion substantially fills the cavity of the first housing portion when the first and second housing portions are arranged in the second position. A proximal portion of the second housing portion may have a shape and volume corresponding to a shape and volume of the cavity of the first housing portion. Advantageously, correspondingly shaped volumes of proximal portion of the second housing portion and cavity means that the proximal portion of the second housing portion substantially fills the cavity of the first housing portion when the first and second housing portions are arranged in the second position. In the second position, access to the cavity is preferably blocked by the second housing portion. In the second position, the second portion and the first portion may be substantially flush, at least in a region at the opening of the cavity of the first housing portion. This prevents insertion of a consumable in the second position. This may also help to remove any debris remaining in the cavity after use. The proximal portion of the second housing portion and the cavity of the first housing portion may be correspondingly shaped in a close fit. A close fit may mean that the proximal portion of the second housing portion can function as a cleaner to scrape the walls of the cavity of the first housing portion as the first and second housing portions are moved from the first position to the second position.

The outer diameter of the proximal portion of the second housing portion may correspond to the inner diameter of the cavity of the first housing portion. The first housing portion may have a hollow cylindrical shape. The proximal portion of the second housing portion arrangeable within the cavity of the first housing portion is preferably cylindrical and may have an outer diameter corresponding to the inner diameter of the hollow cylindrical first housing portion.

The length of the proximal portion of the second housing portion may correspond to the length of the cavity of the first housing portion. The length of the proximal portion of the second housing portion may be measured along the longitudinal axis of the second housing portion. The longitudinal axis of the second housing portion may be identical to one or more of the longitudinal axis of the first housing portion and the longitudinal axis of the aerosol-generating device. The cross-sectional shape of the proximal portion of the second housing portion may correspond to the cross-sectional shape of the cavity of the first housing portion. The proximal portion of the second housing portion may be cylindrical.

As used herein, the terms 'upstream', 'downstream', 'proximal' and 'distal' are used to describe the relative positions of components, or portions of components, of the aerosol-generating device in relation to the direction in which a user draws on the aerosol-generating device during use thereof.

The aerosol-generating device may comprise biasing means configured to bias the first housing portion relative to the second housing portion towards the first position. The biasing means may comprise at least one spring. The biasing means may be configured as at least one spring. Preferably, the biasing means comprise at least two springs. The biasing means may extend parallel to the longitudinal axis of the aerosol-generating device. The biasing means may be arranged around the perimeter of the proximal portion of the second housing portion. The biasing means may be evenly arranged around the perimeter of the proximal portion of the second housing portion. Such an arrangement may facilitate a uniform biasing action.

The biasing means may be arranged between the first housing portion and the second housing portion. The biasing means may be mounted in the first housing portion or in the second housing portion.

The aerosol-generating device may comprise one or more guiding rails configured to guide movement of the second housing portion relative to the first housing portion. The guiding rail may be configured as a groove. The guiding rail may be parallel to the longitudinal axis of the aerosol-generating device. The guiding rail may be arranged in the sidewall of the cavity of the first housing portion. The proximal portion of the second housing portion may comprise a guiding element configured to engage with the guiding rail of the first housing portion. The guiding element may be configured as a protrusion. Alternatively, the second housing portion may comprise the guiding rail and the first housing portion may comprise the guiding element. Exemplarily, the guiding rail may be arranged parallel to the longitudinal axis of the aerosol-generating device on the outer side wall of the proximal portion of the second housing portion. The guiding element may be arranged on the sidewall of the cavity of the first housing portion.

The second housing portion may be configured movable towards the first housing portion in a direction parallel or coaxial with the longitudinal axis of the aerosol-generating device. The second housing portion may be configured movable towards the first housing portion in a direction along the longitudinal axis of the aerosol-generating device.

The aerosol-generating device may comprise locking means. The locking means may be configured to lock the aerosol-generating device in the second position. A user may want to have the aerosol-generating device in the second position, if the aerosol-generating device is not used. The locking means may be utilized for locking the aerosol-generating device in the second position during non-use. For usage of the aerosol-generating device, the locking means may be disengaged. Disengagement of the locking means may lead to the biasing means biasing the aerosol-generating device towards the first position.

The locking means may be any conventional locking means. Exemplarily, the locking means may comprise a male locking element and a female locking element. The male locking element may be configured to engage the female locking element for the locking action. The proximal portion of the second housing portion may comprise the male locking element and the first housing portion may comprise the female locking element or vice versa. For engaging the female locking element, the male locking element may be movable in a lateral direction with respect to the longitudinal axis of the aerosol-generating device. The locking element may be a mechanical locking element. The locking element may be controllable by a user. Alternatively, the locking element may be an electric locking element.

The aerosol-generating device may comprise a wireless communication interface. The wireless communication interface may be configured to interact with an external device for unlocking the locking means. The external device may be a smartphone, smartwatch or tablet. The locking means may be configured to unlock, if the external device is within a predetermined distance around the aerosol-generating device. The locking means may be configured to unlock, if a user inputs an unlocking command into the external device.

The wireless communication interface may comprise authorization means configured to interact with the external device for unlocking the locking means. The authorization means may be configured to identify the aerosol-generating device.

The aerosol-generating device may comprise a heating element. The heating element may be arranged in the first housing portion. The heating element is preferably configured as an external heating element. An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation. The heating element may be configured as a resistive heating element.

Alternatively, the heating element may be configured as an induction heating element. Similarly, the heating element may be configured as an external heating element. The heating element may comprise an induction coil arranged at least partly surrounding the cavity of the first housing portion. The induction coil may be a helical induction coil. The induction coil may have a tubular shape coaxially surrounding the cavity. The induction heating element may further comprise a susceptor.

In general, the susceptor is a material that is capable of absorbing electromagnetic energy and converting it to heat. When located in an alternating electromagnetic field, typically eddy currents are induced and hysteresis losses occur in the susceptor causing heating of the susceptor. Changing electromagnetic fields generated by one or several induction coils heat the susceptor, which then transfers the heat to the aerosol-generating article, such that an aerosol is formed. The heat transfer may be mainly by conduction of heat. Such a transfer of heat is best, if the susceptor is in close thermal contact with the aerosol-generating article. The susceptor may have a tubular shape. The outer diameter of the susceptor may be smaller than the inner diameter of the induction coil. The susceptor may be arranged within the induction coil. The susceptor may form the sidewall of the cavity.

The susceptor may be formed from any material that can be inductively heated to a temperature sufficient to generate an aerosol from the aerosol-forming substrate. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius.

The aerosol-generating device may comprise a controller. The controller may be configured to prevent operation of the aerosol-generating device, preferably prevent operation of the heating element of the aerosol-generating device, when one or both of the first housing portion is in the retracted position; and the locking means are locked.

The controller may be configured to prevent inadvertent operation of the aerosol-generating device. The aerosol-generating device is in the second position, if the aerosol-generating device is not used. Consequently, the controller is configured to prevent operation of the aerosol-generating device, if the aerosol-generating device is in the second position. The second position is typically detected by the locking means being locked. The controller may be configured to enable operation of the aerosol-generating device, if the aerosol-generating device is in the first position. In the first position, the controller may be configured to control operation of the heating element to heat the aerosol-forming substrate of the aerosol-generating article.

The aerosol-generating device may comprise electric circuitry. The electric circuitry may comprise a microprocessor, which may be a programmable microprocessor. The microprocessor may be part of the controller. The electric circuitry may comprise further electronic components. The electric circuitry may be configured to regulate a supply of power to the heating element. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

The aerosol-generating device may comprise a power supply, typically a battery, within the second housing portion of the aerosol-generating device. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the heating element.

The invention further relates to an aerosol-generating system comprising an aerosol-generating device as described herein and an aerosol-generating article comprising aerosol-forming substrate as described herein.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder. The device may be an electrically heated smoking device. The aerosol-generating device may comprise a housing, electric circuitry, a power supply, a cavity and a heating element.

As used herein, the term 'aerosol-generating article' refers to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable.

The aerosol-generating article may be substantially cylindrical in shape. The aerosol-generating article may be substantially elongate. The aerosol-generating article may have a length and a circumference substantially perpendicular to the length. The aerosol-generating article may be substantially rod shaped. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be substantially rod shaped.

As used herein, the term 'aerosol-forming substrate' relates to a substrate capable of releasing one or more volatile compounds that can form an aerosol. Such volatile compounds may be released by heating the aerosol-forming substrate. An aerosol-forming substrate may conveniently be part of an aerosol-generating article or smoking article.

The aerosol-forming substrate may be a solid aerosol-forming substrate. The aerosol-forming substrate may comprise both solid and liquid components. The aerosol-forming substrate may comprise a tobacco-containing material containing volatile tobacco flavour compounds which are released from the substrate upon heating. The aerosol-forming substrate may comprise a non-tobacco material. The aerosol-forming substrate may comprise an aerosol former that facilitates the formation of a dense and stable aerosol. Examples of suitable aerosol formers are glycerine and propylene glycol.

If the aerosol-forming substrate is a solid aerosol-forming substrate, the solid aerosol-forming substrate may comprise, in some embodiments, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

The invention may further relate to a use of the aerosol-generating device. The use may comprise arranging the first housing portion and the second housing portion in the first position. The use may comprise extending the first housing portion relative to the second housing portion. The use may comprise holding of the aerosol-generating device at the first housing portion. The use may comprise extending the first housing portion by holding the first housing portion and pushing the second housing portion. Pushing the second housing portion may free the second housing portion so that the biasing means may bias the first housing portion and the second housing portion towards the first position. The use may comprise inserting the aerosol-generating article into the cavity of the aerosol-generating device. The use may comprise aerosol generation by heating of the aerosol-generating article. The use may comprise extracting of the spent aerosol-generating article from the cavity of the aerosol-generating device.

The aerosol-generating article may be extracted by pushing the second housing portion towards the first housing portion against the biasing force of the biasing means. A user may push with a digit, exemplarily a thumb, against the end face of the second housing portion. As a consequence, the second housing portion may push into the first housing portion. Gradually, the cavity may be occupied by the second housing portion. The aerosol-generating article may be pushed out of the cavity by the proximal end face of the proximal portion of the second housing portion. The second housing portion may be fully pushed into the first housing portion. The proximal end face of the second housing portion may subsequently be flush with the opening of the cavity. The aerosol-generating article may thus be extracted from the cavity. The invention may relate to a method for extracting an aerosol-generating article from the aerosol-generating device comprising any of the steps described herein for extracting the aerosol-generating article.

Features described in relation to one embodiment may equally be applied to other embodiments of the invention.

The invention will be further described, by way of example only, with reference to the accompanying drawings in which:

FIG. 1*a* shows an illustrative side cut view of an aerosol-generating device in the second position;

FIG. 1*b* shows an illustrative side cut view of an aerosol-generating device in the first position, with an aerosol-generating article received in a cavity of a first housing portion of the aerosol-generating device;

Figure 5:
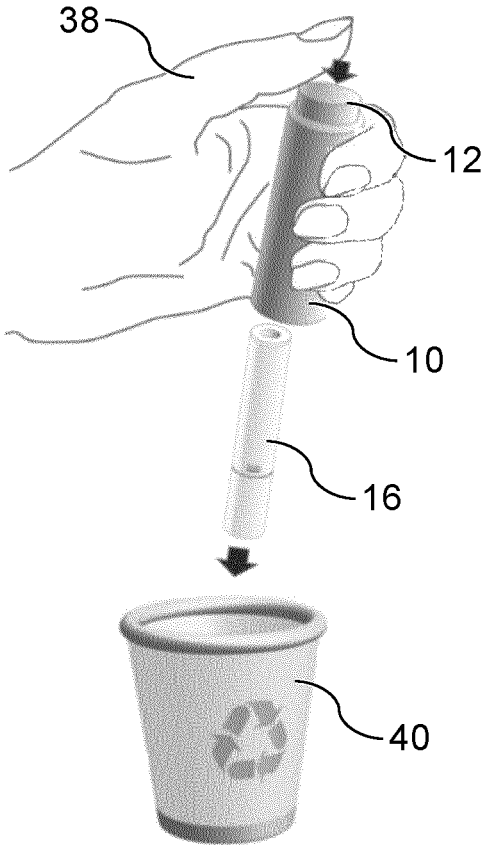
Figures 6A, 6B, 6C:
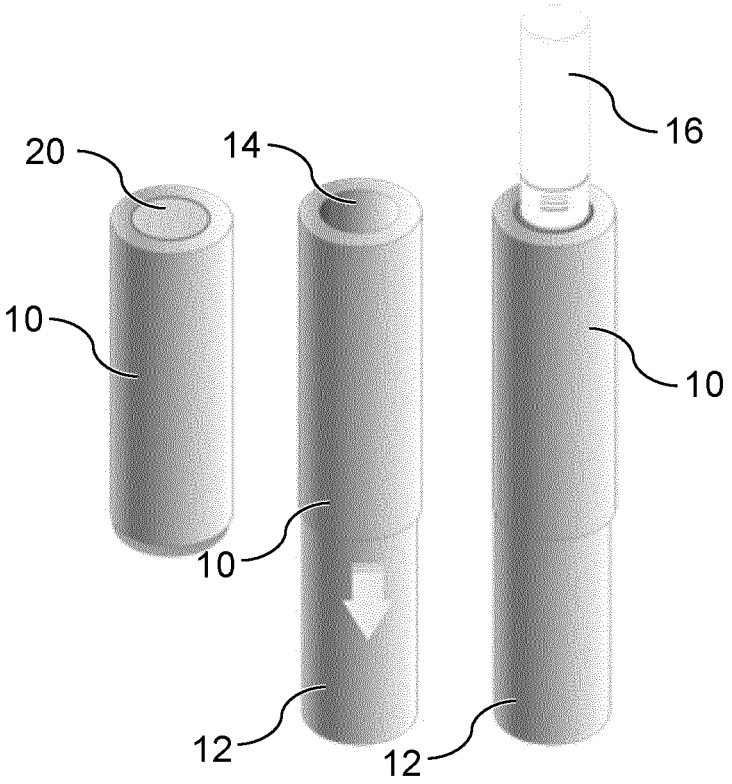

FIGS. 4*a* to 4*e* show illustrative side cut views of the operation of the aerosol-generating device;

FIG. 5 shows an example of extraction of the aerosol-generating article from the aerosol-generating device;

FIG. 6*a* shows a schematic view of the first position of the aerosol-generating device; and FIGS. 6*a*, 6*b* and 6*c* show schematic views of the second position of the aerosol-generating device.

FIG. 1 shows an aerosol-generating device. The aerosol-generating device comprises a first housing portion 10 and a second housing portion 12. The first housing portion 10 is a proximal housing portion. In other words, the first housing portion 10 faces a user, when the device is in use of the aerosol-generating device. The second housing portion 12 is a distal housing portion. In other words, the second housing portion 12 faces away from a user during use of the aerosol-generating device. The first housing portion 10 has a hollow cylindrical shape. The second housing portion 12 has a solid cylindrical shape. The second housing portion 12 is arranged to be at least partly receivable within the first housing portion 10.

The first housing portion 10 comprises a cavity 14. The cavity 14 is configured to receive an aerosol-generating article 16. The cavity 14 has a hollow cylindrical shape. The cavity 14 is arranged adjacent the proximal end of the first housing portion 10. The cavity 14 extends approximately halfway through the first housing portion 10.

Figures 1A, 1B:
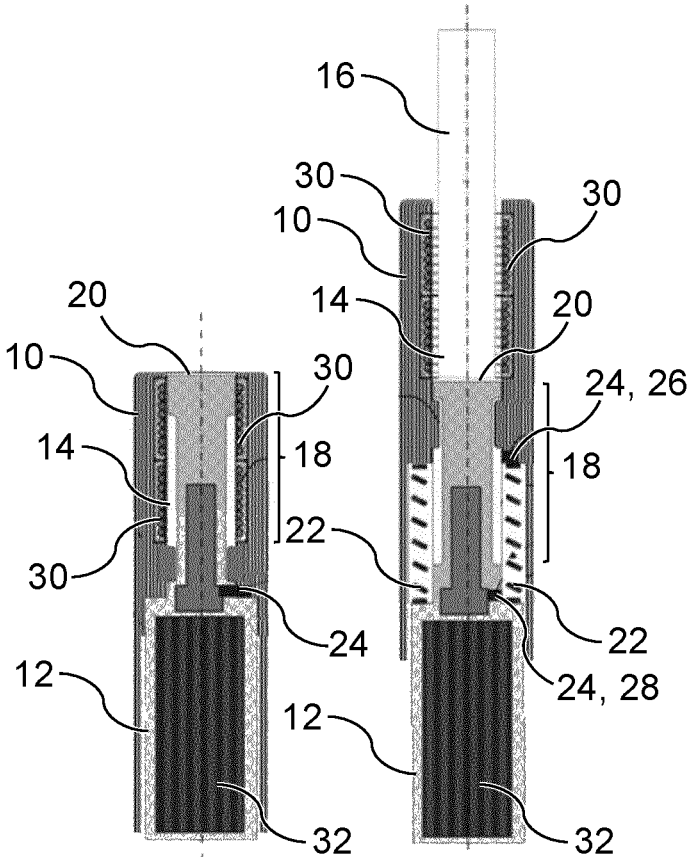

The second housing portion 12 comprises a proximal portion 18. The proximal portion 18 has a length of approximately half the length of the second housing portion 12. The proximal portion 18 is arranged adjacent the proximal end of the second housing portion 12. The proximal portion 18 of the second housing portion 12 is arranged to be received within the first housing portion 10. Consequently, the outer diameter of the proximal portion 18 is smaller than the inner diameter of the cavity 14. A proximal end face 20 of the proximal portion 18 may form a base of the cavity 14. Particularly, the proximal end face 20 forms a base of the cavity 14, when the aerosol-generating device is positioned in a first position. The first position is shown in FIG. 1*b*. In the first position, the aerosol-generating device is in the extended position. The extended position is characterized by the cavity 14 being open. The extended position is further characterized by the second housing portion 12 being arranged in an extended position relative to the first housing portion 10.

FIG. 1*a* shows the aerosol-generating device in a second position. In the second position, the aerosol-generating device is in a retracted position. In this position, the proximal portion 18 of the second housing portion 12 is retracted into the cavity 14 of the first housing portion 10. In the second position, the proximal end face 20 of the proximal portion 18 of the second housing portion 12 is arranged flush with a proximal end of the first housing portion 10. In other words, the proximal end face 20 of the second housing portion 12 is arranged flush with the outlet of the cavity 14. In this way, the cavity 14 is protected from contamination and from a user or bystander reaching into the cavity 14.

FIG. 1*b* further shows biasing means 22 for biasing the aerosol-generating device into the first position. The biasing means 22 are in the embodiment shown in FIG. 1*b* configured as two springs. The biasing means 22 are arranged between the first housing portion 10 and the second housing portion 12. The biasing means 22 are arranged adjacent the perimeter of the proximal portion 18 of the second housing portion 12. The biasing means 22 are arranged adjacent the sidewall of the hollow cylindrical first housing portion 10. The biasing means 22 are arranged upstream of the cavity 14 of the first housing portion 10. The biasing means 22 are configured to bias the first housing portion 10 and the second housing portion 12 away from each other into the first position of the aerosol-generating device.

FIG. 1 further shows locking means 24. The locking means 24 are configured to hold the aerosol-generating device in the second position. In other words, the locking means 24 are configured to hold the second housing portion 12 in the retracted position relative to the first housing portion 10 against the biasing force of the biasing means 22. The locking means 24 may be configured as any conventional locking means 24. In the embodiment shown in FIG. 1, the locking means 24 comprise a male locking element 26 and a female locking element 28. The male locking element 26 is arranged adjacent the sidewall of the first housing portion 10. The female locking element 28 is arranged adjacent the proximal portion 18 of the second housing portion 12. The placement and configuration of the locking means 24 is, however, only exemplary.

Unlocking of the locking means 24 may be facilitated mechanically by a user. Exemplarily, the aerosol-generating device may comprise a pushbutton for unlocking the locking means 24. Alternatively, the locking means 24 may be configured as electrically operated locking means 24 and operated by a controller. The aerosol-generating device may further comprise a communication interface, preferably a wireless communication interface. The communication interface may be configured to interact with an external device for unlocking the locking means 24. The external device may be a smartphone, smartwatch or tablet. The communication interface may receive an output from the external device. The communication interface may subsequently generate an output, which is received by the controller. The controller may then unlock the locking means 24 upon receiving the appropriate output from the communication interface. The communication interface may comprise authorization means to identify a correct external device.

FIG. 1*a* shows the second position, in which the locking means 24 are locked and the second housing portion 12 is held in the retracted state within the first housing portion 10. As a consequence, the cavity 14 of the first housing portion 10 is protected by the appropriately shaped proximal portion 18 of the second housing portion 12. This position is preferably the position in which the aerosol-generating device is arranged, when the device is not used. In FIG. 1*b*, the locking means 24 are unlocked and the biasing means 22 have biased the aerosol-generating device in the first position such that the cavity 14 is accessible. As indicated in FIG. 1*b*, the aerosol-generating article 16 is inserted into the cavity 14 so that the aerosol-generating device can be operated.

For operating the aerosol-generating device, the aerosol-generating device comprises a heating element 30. The heating element 30 is heated for heating the aerosol-forming substrate of the aerosol-generating article 16. The heating element 30 is configured to heat but not burn the aerosol-forming substrate. In the embodiment shown in FIG. 1, the heating element 30 is configured as an induction heating element 30. Consequently, the heating element 30 comprises an induction coil. Further, a susceptor (not shown) is provided for generating the heat for heating the aerosol-forming substrate. The susceptor may be provided as part of the aerosol-generating device, or as part of the aerosol-generating article, or both as part of the aerosol-generating device and as part of the aerosol-generating consumable. The induction coil is arranged around the perimeter of the susceptor. The induction coil is preferably configured as a helical coil. The susceptor is preferably configured as a tubular susceptor surrounding the cavity 14. The susceptor may form the sidewall of the cavity 14.

In the embodiment shown in FIG. 1, the heating element 30 comprises two separate induction coils. One induction coil is arranged surrounding an upstream portion of the cavity 14. The other induction coil is arranged surrounding a downstream portion of the cavity 14. Two induction coils may be utilized to heat different portions of the aerosol-forming substrate of the aerosol-generating article 16. The controller may independently control the induction coils.

FIG. 1 further shows that the second housing portion 12 comprises a power supply 32. The power supply 32 is preferably configured as a battery. The power supply 32 is configured to supply electrical energy to the heating element 30 to operate the heating element 30. The power supply 32 may be controlled by the controller.

Figure 2:
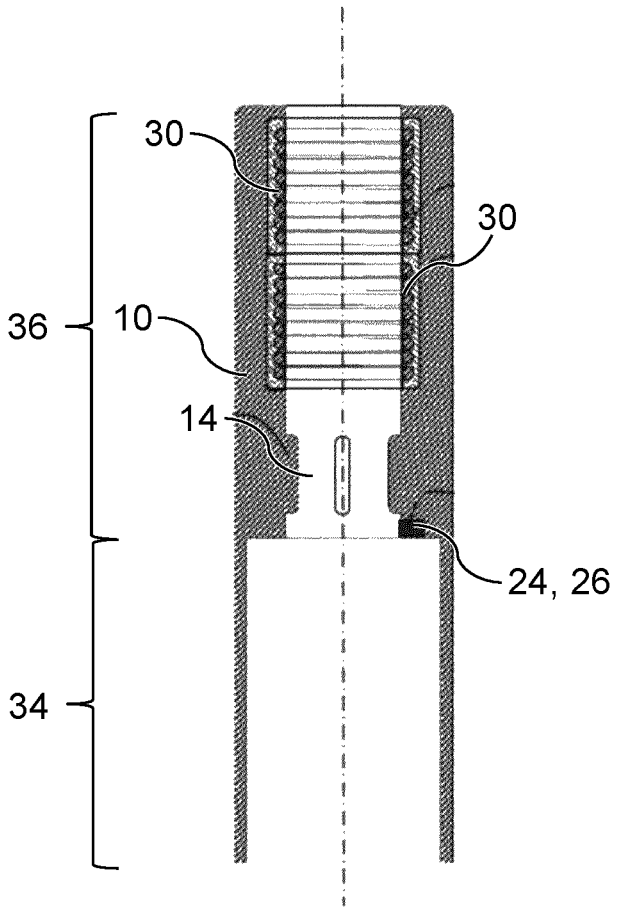
FIG. 2 shows an illustrative side cut view of a first housing portion of the aerosol-generating device.

FIG. 2 shows a more detailed view of the first housing portion 10. Particularly, the hollow cylindrical shape of the first housing portion 10 is shown in FIG. 2. The cavity 14 for insertion of the aerosol-generating article 16 is arranged in a proximal portion 36 of the first housing portion 10. The cavity 14 is surrounded by the heating element 30. The heating element 30 comprises two individual induction coils for heating different areas of the inserted aerosol-generating article 16. The second housing portion 12 is mounted in a distal portion 34 of the first housing portion 10 opposite the proximal portion 36 of the first housing portion 10. The distal portion 34 of the first housing portion 10 consequently has a hollow cylindrical shape so that the second housing portion 12 can be inserted into the first housing portion 10.

Figure 3:
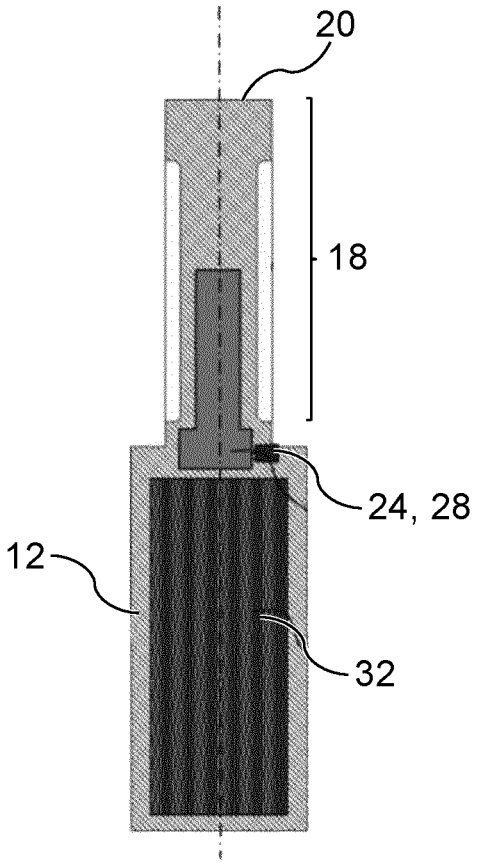
FIG. 3 shows an illustrative side cut view of a second housing portion of the aerosol-generating device.

FIG. 3 shows a more detailed view of the second housing portion 12. Particularly, the proximal portion 18 of the second housing portion 12 with a reduced diameter is shown. This proximal portion 18 of the second housing portion 12 is dimensioned to be arranged within the cavity 14 of the first housing portion 10, when the aerosol-generating device is in the second position.

Figures 4A, 4B, 4C, 4D, 4E:
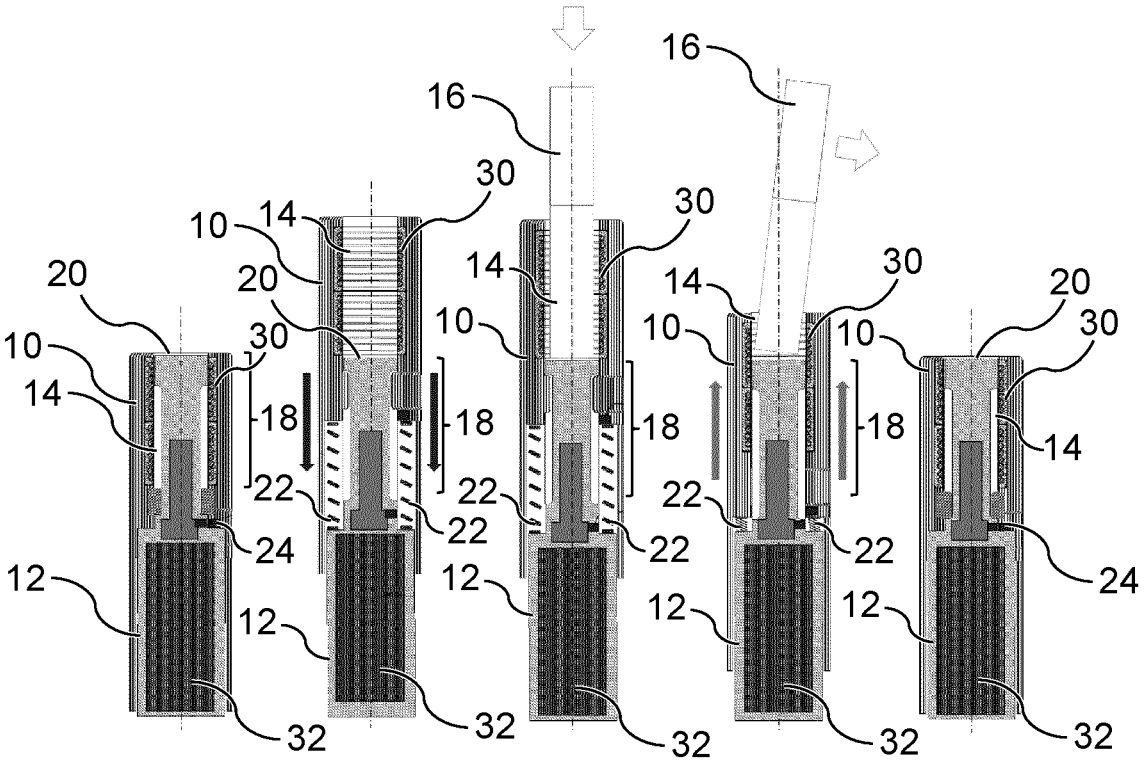

FIG. 4 shows operation of the aerosol-generating device. From left (FIG. 4*a*) to right (FIG. 4*e*), the aerosol-generating device is in a non-used state followed by usage of the aerosol-generating device and subsequently in the non-used state again. FIG. 4*a* shows the aerosol-generating device in the second position. In the second position, the second housing portion 12 is retracted into the first housing portion 10. Further, access to the cavity 14 is blocked by the proximal portion 18 of the second housing portion 12. In FIG. 4*b*, the aerosol-generating device is prepared to be used. To this end, the locking means 24 are disengaged. This engagement of the locking means 24 leads to the biasing means 22 biasing the second housing portion 12 into the extended position relative to the first housing portion 10. Consequently, the aerosol-generating device is in the first position in FIG. 4*b*. In FIG. 4*c*, the aerosol-generating device is inserted into the cavity 14. The cavity 14 is unoccupied by the proximal portion 18 of the second housing portion 12 in the first position of the aerosol-generating device. When the aerosol-generating article 16 is inserted into the cavity 14, the heating element 30 is operated to heat the aerosol-forming substrate of the aerosol-generating article 16. Consequently, an inhalable aerosol is generated that can be inhaled by a user. After the aerosol-generating article 16 is depleted, the aerosol-generating article 16 is removed from the cavity 14. For removing the aerosol-generating article 16 from the cavity 14, the second housing portion 12 can be pushed into the first housing portion 10 as indicated by the arrows in FIG. 4*d*. The second housing portion 12 can be manually pushed into the first housing portion 10 by the user against the biasing force of the biasing means 22. As a consequence, the cavity 14 gradually shrinks due to the proximal portion 18 of the second housing portion 12 being pushed into the cavity 14. Particularly, the proximal end face 20 of the second housing portion 12 forming the base of the cavity 14 is pushed into the cavity 14 until the aerosol-generating article 16 is pushed out of the cavity 14 and can be removed by the user. After the proximal portion 18 of the second housing portion 12 is fully pushed into the first housing portion 10, as indicated in FIG. 4*e*, the aerosol-generating device is again in the second position. The second position of the aerosol-generating device is a compact position, in which undesired access to the cavity 14 is prevented by the positioning of the proximal portion 18 of the second housing portion 12.

FIG. 5 shows an example of extracting the aerosol-generating article 16 from the aerosol-generating device. A user 38 may press on the second housing portion 12, when the aerosol-generating article 16 is depleted. The user 38 may push with a digit, exemplarily a thumb, against the end face of the second housing portion 12. As a consequence, the second housing portion 12 is pushed into the first housing portion 10. Gradually, the cavity 14 is occupied by the second housing portion 12. The aerosol-generating article 16 is pushed out of the cavity 14 by the proximal end face 20 of the proximal portion 18 of the second housing portion 12. Finally, the second housing portion 12 is fully pushed into the first housing portion 10. The proximal end face 20 of the second housing portion 12 is flush with the opening of the cavity 14. The aerosol-generating article 16 is thus extracted from the cavity 14. The aerosol-generating article 16 may be disposed in a recycle bin 40.

FIG. 6*a* shows the first housing portion 10 and the second housing portion 12 of the aerosol-generating device in the second position. In the second position, the first housing portion 10 and the second housing portion 12 are arranged in a retracted position. In this position, the proximal portion 18 of the second housing portion 12 is arranged within the cavity 14. As a consequence, the proximal end face 20 of the proximal portion 18 is arranged flush with the opening of the cavity 14 as shown in FIG. 6*a*.

FIG. 6*b* shows the first housing portion 10 and the second housing portion 12 arranged in the first position, which is an extended position. The cavity 14 is accessible. As shown in FIG. 6*c*, the aerosol-generating article 16 can be inserted into the cavity 14. The aerosol-generating device can then be operated by heating the aerosol-forming substrate of the aerosol-generating article 16. When the aerosol-generating article 16 is depleted, the aerosol-generating article 16 can be extracted as described in conjunction with FIG. 5. For extracting the aerosol-generating article 16, the second housing portion 12 can be pushed towards the first housing portion 10 such that the aerosol-generating device is arranged again in the second position shown in FIG. 6*a*.

The invention claimed is:

1. An aerosol-generating device comprising:

a first housing portion; and a second housing portion, wherein the first housing portion comprises a cavity for receiving an aerosol-generating article comprising aerosol-forming substrate, wherein the first housing portion and second housing portion are configured arrangeable in a first position, in which the first housing portion is extended relative to the second housing portion, and in which the cavity is accessible for insertion of the aerosol-generating article, wherein the first housing portion and second housing portion are configured arrangeable in a second position, in which the second housing portion is retracted at least partly within the cavity, wherein the aerosol-generating device is configured to heat the aerosol-generating article in the first position, and wherein, in the second position, the cavity lacking the aerosol-generating article is inaccessible for insertion of the aerosol-generating article.

2. The aerosol-generating device according to claim 1, wherein a proximal portion of the second housing portion has a shape corresponding to a shape of the cavity of the first housing portion.

3. The aerosol-generating device according to claim 1, wherein the aerosol-generating device comprises biasing means configured to bias the first housing portion relative to the second housing portion towards the first position.

4. The aerosol-generating device according to claim 3, wherein the biasing means comprises at least one spring.

5. The aerosol-generating device according to claim 3, wherein the biasing means is arranged between the first housing portion and the second housing portion.

6. The aerosol-generating device according to claim 1, wherein the aerosol-generating device comprises one or more guiding rails configured to guide movement of the second housing portion relative to the first housing portion.

7. The aerosol-generating device according to claim 1, wherein the second housing portion is configured movable towards the first housing portion in a direction parallel or coaxial with the longitudinal axis of the aerosol-generating device.

8. The aerosol-generating device according to claim 1, wherein the aerosol-generating device comprises locking means, and wherein the locking means are configured to lock the aerosol-generating device in the second position.

9. The aerosol-generating device according to claim 8, wherein the aerosol-generating device comprises a wireless communication interface, and wherein the wireless communication interface is configured to interact with an external device for unlocking the locking means.

10. The aerosol-generating device according to claim 9, wherein the wireless communication interface comprises authorization means configured to interact with the external device for unlocking the locking means.

11. The aerosol-generating device according to claim 1, wherein the aerosol-generating device comprises a heating element, and wherein the heating element is arranged in the first housing portion.

12. The aerosol-generating device according to claim 11, wherein the heating element comprises an induction coil arranged at least partly surrounding the cavity of the first housing portion.

13. The aerosol-generating device according to claim 8, wherein the aerosol-generating device comprises a controller, and wherein the controller is configured to prevent operation of the aerosol-generating device, when one or both of:

the first housing portion is in the second position; and the locking means are locked.

14. The aerosol-generating device according to claim 1, wherein the first housing portion has a hollow cylindrical shape, and wherein the portion of the second housing portion arrangeable within the cavity of the first housing portion is cylindrical and has an outer diameter corresponding to the inner diameter of the hollow cylindrical first housing portion.

15. An aerosol-generating system comprising the aerosol-generating device according to claim 1 and an aerosol-generating article comprising aerosol-forming substrate.

16. The aerosol-generating device according to claim 8, wherein the aerosol-generating device comprises a controller, and wherein the controller is configured to prevent operation of a heating element of the aerosol-generating device, when one or both of:

the first housing portion is in the second position; and the locking means are locked.

17. The aerosol-generating device according to claim 1, wherein the aerosol-generating device is configured to be operated to generate an inhalable aerosol in the first position.

18. The aerosol-generating device according to claim 1, wherein in the second position, the cavity is taken up by the second housing portion.

19. The aerosol-generating device according to claim 1, wherein in the second position, access to the cavity is blocked by the second housing portion.

20. The aerosol-generating device according to claim 1, wherein the cavity is a heating chamber.

21. The aerosol-generating device according to claim 1, wherein the cavity has a base at an upstream end of the cavity and wherein the base of the cavity is formed by a proximal end face of the second housing portion.

* * * * *